US006572754B2

(12) United States Patent
Reiter

(10) Patent No.: US 6,572,754 B2
(45) Date of Patent: Jun. 3, 2003

(54) METHOD FOR PRODUCING A TIN FILM ON THE INNER SURFACE OF HOLLOW COPPER ALLOY COMPONENTS

(75) Inventor: Ulrich Reiter, Osnabrück (DE)

(73) Assignee: KM Europa Metal AG, Osnabruck (DE)

( * ) Notice: Subject to any disclaimer, the term of this patent is extended or adjusted under 35 U.S.C. 154(b) by 138 days.

(21) Appl. No.: 09/772,331

(22) Filed: Jan. 29, 2001

(65) Prior Publication Data

US 2001/0010834 A1 Aug. 2, 2001

(30) Foreign Application Priority Data

Jan. 28, 2000 (DE) ..... 100 03 582

(51) Int. Cl.[7] ..... C23C 18/24

(52) U.S. Cl. ..... 205/85; 205/131; 205/151; 205/215; 427/239; 427/309; 427/436

(58) Field of Search ..... 205/85, 118, 131, 205/151, 205, 210, 215; 427/239, 436, 309

(56) References Cited

U.S. PATENT DOCUMENTS 2,282,511 A * 5/1942 Bradley ..... 117/130
4,751,049 A * 6/1988 Shannon ..... 420/477
5,169,692 A * 12/1992 Couble et al. ..... 427/436
5,211,831 A * 5/1993 Vitale et al. ..... 427/98
5,919,519 A * 7/1999 Tallis ..... 427/239
6,045,860 A * 4/2000 Ito et al. ..... 427/232
6,197,210 B1 * 3/2001 Myerson ..... 216/106

FOREIGN PATENT DOCUMENTS

| | | | |
|---|---|---|---|
| EP | 0 683 245 | | 11/1995 |
| IT | WO 97-06313 | * | 2/1997 |
| WO | WO 97/06313 | | 2/1997 |

OTHER PUBLICATIONS

Julius Grant, editor, Hackh's Chemical Dictionary, fourth edition, McGraw–Hill Book Company, New York, 1969, pp 329.*

* cited by examiner

*Primary Examiner*—Nam Nguyen
*Assistant Examiner*—William T. Leader
(74) *Attorney, Agent, or Firm*—Kenyon & Kenyon

(57) ABSTRACT

A method for producing an inner tin film on the surface of plumbing components, such as those made of red brass or yellow brass, for drinking water supply. The lead content on the inner surface of the hollow component parts is first reduced by treatment with an acid-based aqueous reducing solution. For this purpose, chloride-free and sulfate-free, non-oxidizing hydracids may be used. The hollow component parts are subsequently chemically internally tinned.

6 Claims, No Drawings

METHOD FOR PRODUCING A TIN FILM ON THE INNER SURFACE OF HOLLOW COPPER ALLOY COMPONENTS

FIELD OF THE INVENTION

The present invention relates to a method of producing a tin film on the inner surface of hollow component parts, such as tubes, tube joints or fittings, made of a copper alloy, such as red brass or yellow brass. The tin film serves to restrict the solubility of the copper in water.

BACKGROUND OF THE INVENTION

Plumbing component parts of copper or copper alloys have proven successful for drinking water supply installations in homes. There is a limit for copper ion release of 2 mg/l to be maintained during twelve-hour stagnation of the water, thus the general object is to avoid direct contact between copper and water by using an inner coating. To ensure a suitable water quality for human consumption as per drinking water regulations, plumbing parts tinned on the inside are preferably installed.

A common method for internal tinning of copper tube is the chemical deposition of tin on the inner surface of the copper tube, as described, for instance, in U.S. Pat. No. 2,282,511. For this purpose, the inside of the copper tube is washed with a chemical tinning solution. The tin is then deposited through a simple chemical metal displacement (ion exchange). Copper ions dissolve from the base metal and an equivalent quantity of tin ions is simultaneously deposited from the tinning solution. This takes place under the influence of the potential existing between the tinning solution and the copper. An external voltage or an electric current is not required.

Chemical tinning is especially useful because of its simple method of operation at comparatively low cost for the equipment required. In addition, tin can be deposited on the inside of hollow component parts, which are generally quite difficult to access.

However, a disadvantage is the fact that the exchange of tin ions with copper ions takes place in dependence upon the available potential difference between the tinning solution and the copper component. Therefore, the rate of deposition decreases as a function of the thickness of the film already deposited, or the potential difference. This causes an irregular film formation when working with materials having non-homogeneous surfaces. The reaction stops as soon as the base metal is completely covered by the coating.

In this connection, it was discovered that, with lead-containing copper alloys, particularly with red or yellow brass, tinning success is hindered by the lead in the surface to be tinned. The lead which exists on the surface, and which, at up to 30%, is as a rule distinctly more concentrated than in the alloy as a whole, interferes with the ion exchange of tin and copper ions. This is detrimental to the adhesion of the tin film to the surface of the hollow component to be tinned. Also, it is usually only possible to achieve tin films having a thickness of less than 1 $\mu$m. Furthermore, it was determined that migration of lead from the base material into the drinking water is essentially not decreased by the tin film.

In the case of plumbing components made of alloys of leaded copper for drinking water supply installations, the principle of decreasing the release of lead by treating the components with an aqueous reducing solution based on acid is generally known. Such proposals may be seen in European Patent Application No. 0 683 245 and in International Publication No. WO 97/06313.

SUMMARY OF THE INVENTION

The object of the present invention is to indicate a method for the internal tinning of hollow component parts made lead-containing copper alloys, which permits greater tin film thicknesses with improved adhesion.

According to the present invention, this object is achieved as follows. First, the lead content on the inner surface of the hollow component part is reduced by treatment with an acid-based aqueous reducing solution, such as, for example, a hydracid. Next, the hollow component parts are chemically tinned.

DETAILED DESCRIPTION

The method of the present invention allows for etchingly removing the lead on the inner surface, which hinders the ion exchange of tin and copper ions, by treatment with an acid-based aqueous reducing solution, or rather achieves almost lead-free surfaces, before they are chemically tinned, in the usual manner, in a subsequent treatment step. The method of the present invention is suitable for internal tinning of plumbing components made of red brass or yellow brass, for example.

The lead, situated on the surface to be tinned, which cannot be eliminated with the customary degreasing procedures, is removed by the targeted treatment before tinning. In this process, chloride-free and sulfate-free, non-oxidizing hydracids, for example, can be used as reducing solutions.

The achievable thickness of tin films in the subsequent tinning process is markedly greater than 1 $\mu$m. In addition, adhesion of the tin film to the base material is considerably improved. Furthermore, the lead permeability of the tin film is also perceptibly reduced.

The method of the present invention can be implemented economically in process-automated production processes. As usual, the hollow components are first degreased internally with an alkaline or an acid cleaning medium. After the degreasing operation, the hollow components are rinsed with water. If applicable, this can be followed by a further pickling pretreatment of the inner surface. After pickling, rinsing with fully desalted water can optionally be performed.

In a separate rinsing operation with a chloride-free and sulfate-free, non-oxidizing hydracid, the lead is then eliminated from the inner surface. Subsequently, a repeat rinsing operation is carried out, before the hollow components are washed thoroughly with a tinning solution. After the tinning operation, the copper tube is washed cold or hot, and dried.

What is claimed is:

1. A method for producing a tin film for limiting copper solubility in water, on the inner surface of hollow component parts made of a lead-containing copper alloy, said method comprising the steps of:

providing a hollow component part made of a lead-containing copper alloy;

reducing lead content on the inner surface of the hollow component part by treatment with an acid-based aqueous reducing solution, wherein a hydracid is used as the reducing solution; and chemically tinning the hollow component part, wherein the tin film produced on the surface is greater than 1 $\mu$m.

2. The method of claim 1, wherein the reducing solution is a chloride-free and sulfate-free, non-oxidizing hydracid.

3. The method of claim 1, wherein the hollow component parts are selected from the group consisting of tubes, tube joints and fittings.

4. The method of claim 1, wherein the lead-containing copper alloy is a yellow brass or red brass copper alloy.

5. A method for producing a tin film on the inner surface of a hollow component plumbing part made of a lead-containing copper alloy selected from the group consisting of a red brass or yellow brass copper alloy, the method consisting essentially of the steps of:

providing a hollow component plumbing part made of a lead-containing copper alloy selected from the group consisting of a red brass or yellow brass copper alloy;

reducing lead content on the inner surface of the hollow component plumbing part by treatment with an acid-based aqueous reducing solution, wherein a hydracid is used as the reducing solution; followed by chemically tinning the hollow component part, wherein the tin film produced on the surface is greater than 1 $\mu$m.

6. A method for producing a tin film on the inner surface of a hollow component plumbing part made of a lead-containing copper alloy selected from the group consisting of a red brass or yellow brass copper alloy, the method consisting essentially of the steps of:

providing a hollow component plumbing part made of a lead-containing copper alloy selected from the group consisting of a red brass or yellow brass copper alloy;

reducing lead content on the inner surface of the hollow component plumbing part by treatment with an acid-based aqueous reducing solution, wherein the reducing solution is a chloride-free and sulfate-free, non-oxidizing hydracid; followed by chemically tinning the hollow component part, wherein the tin film produced on the surface is greater than 1 $\mu$m.

* * * * *